US005729786A

United States Patent [19]

Yamada et al.

[11] Patent Number: 5,729,786

[45] Date of Patent: Mar. 17, 1998

[54] IMAGE FORMING CONTROL APPARATUS WHICH RETREIVES CONTROL RULES VIA CONTROL CASES STORED IN CONTROL CLUSTERS

[75] Inventors: Kunio Yamada; Kiyotaka Ishikawa, both of Kanagawa, Japan

[73] Assignee: Fuji Xerox Co., Ltd., Tokyo, Japan

[21] Appl. No.: 526,876

[22] Filed: Sep. 12, 1995

[30] Foreign Application Priority Data

Sep. 13, 1994 [JP] Japan ..... 6-218824

[51] Int. Cl.[6] ..... G03G 15/00

[52] U.S. Cl. ..... 399/142; 399/49; 364/274.5; 364/DIG. 1

[58] Field of Search ..... 355/204, 208, 355/214, 246; 395/23; 364/274.4, 274.5, 274.6; 399/42, 49

[56] References Cited

U.S. PATENT DOCUMENTS

| | | | |
|---|---|---|---|
| 5,216,463 | 6/1993 | Morita | 355/208 |
| 5,220,373 | 6/1993 | Kanaya | 355/204 |
| 5,237,370 | 8/1993 | Murai | 355/208 |
| 5,262,833 | 11/1993 | Fukushima et al. | 355/327 |
| 5,307,118 | 4/1994 | Morita | 355/208 |
| 5,307,443 | 4/1994 | Tanaka | 395/3 |
| 5,377,321 | 12/1994 | Kaneko et al. | 395/163 |
| 5,465,320 | 11/1995 | Enbutsu et al. | 395/22 |
| 5,477,308 | 12/1995 | Ohnishi et al. | 355/246 |

FOREIGN PATENT DOCUMENTS

| | | |
|---|---|---|
| 63-177176 | 7/1988 | Japan . |
| 63-177177 | 7/1988 | Japan . |
| 63-177178 | 7/1988 | Japan . |
| 4-319971 | 11/1992 | Japan . |
| 4-320278 | 11/1992 | Japan . |

*Primary Examiner*—Robert Beatty

*Attorney, Agent, or Firm*—Finnegan, Henderson, Farabow, Garrett & Dunner, L.L.P.

[57] ABSTRACT

Solid and highlight developed image patches are formed, and their densities are measured with a development density sensor and stored into a control case memory as data constituting a control case. Two additional control cases are similarly stored into the control case memory while a scorotron set value and a laser set value are varied. Receiving these control cases through a status quantity comparator and a cluster memory, a control rule calculation unit determines a control rule. By properly combining the control rules, new operation quantities, i.e., a scorotron set value and a laser set value, are determined.

19 Claims, 8 Drawing Sheets

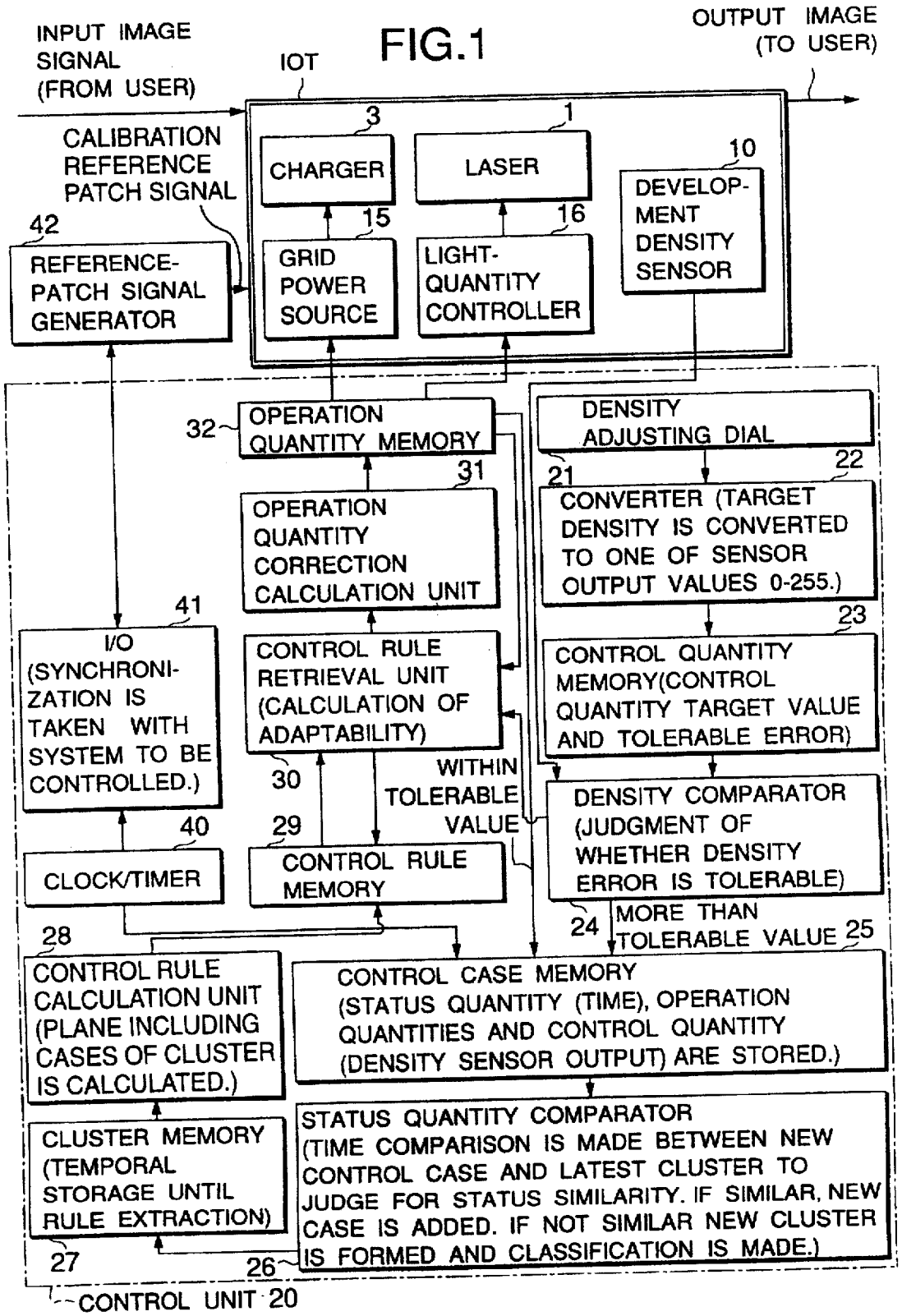
FIG.1
INPUT IMAGE SIGNAL (FROM USER)
IOT
OUTPUT IMAGE (TO USER)
CALIBRATION REFERENCE PATCH SIGNAL
3
CHARGER
1
LASER
10
DEVELOP-MENT DENSITY SENSOR
42
REFERENCE-PATCH SIGNAL GENERATOR
15
GRID POWER SOURCE
16
LIGHT-QUANTITY CONTROLLER
32
OPERATION QUANTITY MEMORY
DENSITY ADJUSTING DIAL
21
22
CONVERTER (TARGET DENSITY IS CONVERTED TO ONE OF SENSOR OUTPUT VALUES 0-255.)
31
OPERATION QUANTITY CORRECTION CALCULATION UNIT
41
I/O (SYNCHRONI-ZATION IS TAKEN WITH SYSTEM TO BE CONTROLLED.)
CONTROL RULE RETRIEVAL UNIT (CALCULATION OF ADAPTABILITY)
23
CONTROL QUANTITY MEMORY(CONTROL QUANTITY TARGET VALUE AND TOLERABLE ERROR)
30
WITHIN TOLERABLE VALUE
DENSITY COMPARATOR (JUDGMENT OF WHETHER DENSITY ERROR IS TOLERABLE)
40
29
CLOCK/TIMER
CONTROL RULE MEMORY
24
MORE THAN TOLERABLE VALUE
25
28
CONTROL RULE CALCULATION UNIT (PLANE INCLUDING CASES OF CLUSTER IS CALCULATED.)
CONTROL CASE MEMORY (STATUS QUANTITY (TIME), OPERATION QUANTITIES AND CONTROL QUANTITY (DENSITY SENSOR OUTPUT) ARE STORED.)
CLUSTER MEMORY (TEMPORAL STORAGE UNTIL RULE EXTRACTION)
STATUS QUANTITY COMPARATOR (TIME COMPARISON IS MADE BETWEEN NEW CONTROL CASE AND LATEST CLUSTER TO JUDGE FOR STATUS SIMILARITY. IF SIMILAR, NEW CASE IS ADDED. IF NOT SIMILAR NEW CLUSTER IS FORMED AND CLASSIFICATION IS MADE.)
27
26
CONTROL UNIT 20

IMAGE FORMING CONTROL APPARATUS WHICH RETREIVES CONTROL RULES VIA CONTROL CASES STORED IN CONTROL CLUSTERS

BACKGROUND OF THE INVENTION

1. Field of the Invention

The present invention relates to an image forming apparatus based on the xerographic process, and more particularly to an image forming apparatus which carries out a control to keep the quality of an image quality at a preset value at low cost and with high precision, and remarkably reduces the number of process steps required for data gathering and optimizing design in product development.

2. Discussion of the Related Art

In the image forming apparatus based on the xerographic process, a feedback control is widely used for optimizing an image density. The image density control is used for the reason that in the electrostatic printing, when such ambient conditions as temperature and humidity, and the characteristics of the photoreceptor and developer vary by aging, an image output state of the apparatus per se varies and a density reproduction performance varies.

In the feedback control, a density reproduction state is monitored by a density patch, a difference between the monitored density and a desired or target density is obtained, and the obtained difference is multiplied by a feedback gain, to thereby compute a quantity of correcting a set value of a control actuator.

In many cases, a developed image patch is used as the above density patch. The reason for this is that the developed image is more easily formed and erased than a transferred image or a fixed image on a paper, and that the developed image has a high correlation of density with a fixed image used by users. Examples of the control actuators, usually used, are the voltage applied to the charger, the quantity of exposure light, and the developing bias voltage, those greatly influencing the developing characteristics.

In the techniques disclosed in Published Unexamined Japanese Patent Application Nos. Sho. 63-177176, Sho. 63-177177 and Sho. 63-177178, the developing potential is varied to control the developed image density to a desired value. This technique is available for both the developing processes of the one- and two-component type.

The optimum developing potential is constantly influenced by uncontrollable external factors, such as temperature, humidity, and the number of accumulated prints. These factors must be taken into account in setting the charging potential, the quantity of exposure light, and the developing bias voltage. The relationship between such status quantities as temperature and humidity and the charging potential, the quantity of exposure light, and the developing bias voltage, is extremely complicated. A satisfactory physical model of the relationship has not been constructed at the present stage of technology.

There is an approach of the density control based on the quantization of the relationship by the approximation expression. In the electrostatic printing, the charging potential, the quantity of exposure light, and the developing bias voltage nonlinearly vary with respect to the status quantities. This makes it difficult to realize an exact control. The result is the necessity of preparatory work to grasp the influences on the image output state by various ambient conditions, such as high and low temperature and humidity, and by aging as well. To increase the control accuracy, data must be gathered closely under a wider variety of conditions, so that a very large number of product development steps is needed.

Further, a feedback gain determined through the very large number of steps is not always optimal because of differences among individual apparatuses and varied conditions under which the apparatus used. In particular, influences of aging degradations on the image density greatly depend on the degrees of degradation of parts of each apparatus and how it is used. Accordingly, the long-term density control performance of the image forming apparatus in the market is not always satisfactory.

The control method as mentioned above frequently requires potential sensors for monitoring the charging potential and the exposure potential as interim parameters for securing a desired control accuracy, and other sensors for monitoring such ambient conditions as temperature and humidity. This leads to increase of cost to manufacture.

Recently, there are proposals using a fuzzy control or a neural network technology as disclosed in Published Unexamined Japanese Patent Application Nos. Hei. 4-319971 and Hei. 4-320278. These proposals use the fuzzy control and the neural network only for the means to improve the control accuracy by making use of the capability of the fuzzy control and the neural network which can cope with the complicated nonlinear relationship between the input and output. For this reason, the proposals can little solve the above-mentioned problems: the enormous increase of the product developing process steps by the gathering of a tremendous amount of data, for example, the increase of manufacturing cost by using the sensors, and failure of securing the satisfactory, long-term density control performance of the image forming apparatus in the market.

Where the fuzzy control and the neural network are used, many sensors are used in order to fully utilize the feature that those are well operable in the multi-input/multi-output operation. The result is a further increase of manufacturing cost.

The fuzzy control requires the tuning of the membership functions by the engineers. In the neuro-network, an automatic learning work is possible, but the teacher data for it must be prepared by the engineer, consuming a large number of product developing process steps.

Even in the fuzzy control or the neural network basis control, which is designed in consideration of the aging degradation data gathered in advance, if the input-output relationship has varied by the aging degradation, the individual performance variations of the machines, and parts exchange, the control cannot cope with the variation of the input-output relationship autonomously. In other words, even the fuzzy control or the neural-network-based control cannot provide a satisfactory, long-term density control performance of the image forming apparatus in the market.

SUMMARY OF THE INVENTION

The present invention has been made in view of the above circumstances and has an object of providing an image forming apparatus which reduces the number of sensors as small as possible and hence the cost to manufacture. The invention succeeds in eliminating the use of the potential sensor, temperature sensor, and the humidity sensor, which are used in addition to the image density sensor in the conventional art.

Another object of the present invention is to provide an image forming apparatus which can automatically and accurately control an image density to a desired density without previously knowing the adverse affects on the image density by ambient conditions and performance deterioration by aging, to thereby realize a remarkable reduction of the product developing process steps.

Still another object of the present invention is to provide an image forming apparatus which can secure required image density control performance of each of a large number of apparatuses in the market which are used in various ways, or subjected to necessary part exchange.

Yet another object of the present invention is to provide an image forming apparatus which allows an operator to directly designate and set in the apparatus a required control accuracy, and autonomously operates so as to satisfy the control accuracy, thereby eliminating increases of the manufacturing cost and the number of product development steps, which would otherwise be required for the control accuracy improvement.

A further object of the present invention is to provide an image forming apparatus which can achieve the abovementioned objects with limited memory capacity.

To attain the above objects, according to the invention, there is provided an image forming apparatus (first apparatus) comprising:

image quality varying means for varying quality of an output image in accordance with an operation quantity;

control case storing means for storing a plurality of control cases;

control rule extracting means for extracting a control rule from the control cases stored in the control case storing means;

detecting means for detecting the quality of the output image, and outputting a detection result as a control quantity; and operation quantity computing means for computing a new operation quantity to be supplied to the image quality varying means so that the control quantity becomes a value corresponding to target image quality, by using the control rule extracted by the control rule extracting means.

According to another aspect of the invention, there is provided an image forming apparatus (second apparatus) comprising:

image quality varying means for varying quality of an output image in accordance with an operation quantity;

cluster storing means for storing, as a cluster, a collection of control cases that are similar in a status quantity;

cluster-discriminated control rule extracting means for extracting control rules for the respective clusters stored in the cluster storing means;

detecting means for detecting the quality of the output image, and outputting a detection result as a control quantity; and control quantity computing means for computing a new control quantity to be supplied to the image quality varying means so that the control quantity becomes a value corresponding to target image quality, by using the control rules extracted by the cluster-discriminated control rule extracting means.

There is provided an image forming apparatus (third apparatus) in which in the second apparatus, the operation quantity computing means determines adaptabilities of the respective control rules extracted by the cluster-discriminated control rule extracting means to a current control case, weights the control rules in accordance with the respective adaptabilities, calculates an average of the weighted control rules, and determines the new operation quantity by using the average control rule.

There is provided an image forming apparatus (fourth apparatus) in which in the third apparatus, the control rule computing means determines the adaptabilities by normalizing reciprocals of distances between a coordinate point of the current control case and n-dimensional planes representing the respective control rules in a coordinate space for describing the control rules.

There is provided an image forming apparatus (fifth apparatus) in which in the third apparatus, the operation quantity computing means computes the new operation quantity by using part of the control rules excluding control rules having the adaptabilities smaller than a predetermined value.

There is provided an image forming apparatus (sixth apparatus) which, in the first apparatus, further comprises comparing means for comparing the control quantity with the target image quality, and in which when a comparison result is larger than a tolerable value, a current control case is stored into the control case storing means so as to be used for subsequent control operations.

There is provided an image forming apparatus (seventh apparatus) which, in the second apparatus, further comprises comparing means for comparing the control quantity with the target image quality, and in which when a comparison result is larger than a tolerable value, a current control case is added to a corresponding one of the clusters stored in the cluster storing means so as to be used for subsequent control operations.

There is provided an image forming apparatus (eighth apparatus) in which in the sixth apparatus, when a residual memory capacity of the control case storing means becomes smaller than a predetermined value as a result of the additional storage of the current control case, an oldest control case is erased from the control case storing means.

There is provided an image forming apparatus (ninth apparatus) in which in the seventh apparatus, when a residual memory capacity of the cluster storing means becomes smaller than a predetermined value as a result of the addition of the current control case, an oldest control case is erased from the cluster storing means.

There is provided an image forming apparatus (tenth apparatus) which, in the third apparatus, further comprises control rule storing means for storing the control rules together with time data indicating time points of formation of the respective control rules, and for updating and storing accumulative values of the adaptabilities of the respective control rules, and in which when a residual memory capacity of the control rule storing means becomes smaller than a predetermined value, a control rule formed before a predetermined time point and having a smallest accumulative adaptability is erased from the control rule storing means.

There is provided an image forming apparatus (eleventh apparatus) which, in the second apparatus, further comprises control case storing means for storing control cases, in which the cluster storing means stores, as the cluster, a collection of control cases that are stored in the control case storing means and similar in the status quantity, and in which when one cluster is completed, control cases constituting the one cluster is erased from the control case storing means.

There is provided an image forming apparatus (twelfth apparatus) in which in the first or second apparatus, each of the control cases consists of the operation quantity, the control quantity, and a status quantity that indicates a status of the image forming apparatus.

There is provided an image forming apparatus (thirteenth apparatus) in which in the first or second apparatus, the control rule is extracted as an n-dimensional, least-square-error plane of a plurality of coordinate points indicating the control cases in an (n+1)-dimensional space that is constituted of n axes representing n operation quantities and an axis representing the control quantity.

There is provided an image forming apparatus (fourteenth apparatus) in which in the first or second apparatus, the output image quality is an image density.

In the first image forming apparatus having the above constitution, when the apparatus is operated for image formation, control cases are progressively stored in the control case storing means. The control rule extracting means extracts a control rule by using the control cases stored. The operation quantity computing means compares a control quantity detected by the detecting means with a desired quality, and obtains an operation quantity so that the control quantity approaches to the desired quality. In this case, the operation quantity is computed while referring to the extracted control rule. The resultant operation quantity is based on the past control case. The operation quantity is supplied to the image quality varying means, whereby the image quality is controlled.

In the second image forming apparatus, when the control cases are stored into the cluster storing means, the control cases, which are similar in the status quantity of the image forming apparatus, are collected and stored in the form of a cluster. The cluster-discriminated control rule extracting means extracts a control rule for each cluster. The operation quantity computing means computes an operation quantity by using each control rule. Accordingly, a control rule necessary for the next control may properly be selected, to thereby ensure a control well adequate for the current situation.

According to the third image forming apparatus, the control is greatly influenced by the clusters closely related thereto and less influenced by the clusters remotely related thereto, so that the control is carried out so as to properly follow up a varying situation.

According to the fourth image forming apparatus, the adaptability can be computed in the coordinate space and, hence, the computation can be performed at high speed.

According to the fifth image forming apparatus, remotely related clusters can be neglected and, therefore, control suitable for the current situation can be performed with high accuracy.

According to the sixth and seventh image forming apparatus, a control case can be taken in accordance with the tolerable value. The control accuracy of the image forming apparatus can be set at a desired level by properly setting a tolerable value.

According to the eighth and ninth image forming apparatus, the memory can be used effectively.

According to the tenth image forming apparatus, the least important control rule is erased.

According to the eleventh image forming apparatus, the memory can be used efficiently.

According to the twelfth image forming apparatus, control cases can be classified based on a status quantity that reflects ambient conditions. For example, control cases can be classified into clusters in accordance with the status quantity.

According to the thirteenth image forming apparatus, a control rule having smaller statistical errors can be generated.

According to the fourteenth image forming apparatus, since the output image quality is an image density, for instance in a copying machine, the important factor to determine the image quality is controlled on the basis of the past control cases.

BRIEF DESCRIPTION OF THE DRAWINGS

FIG. 1 is a block diagram showing a configuration of a control unit according to an embodiment of the present invention;

DETAILED DESCRIPTION OF THE PREFERRED EMBODIMENTS

Configuration of Embodiment (1) Basic Configuration

The preferred embodiment of an image forming apparatus according to the present invention will be described with reference to the accompanying drawings.

Figure 2:
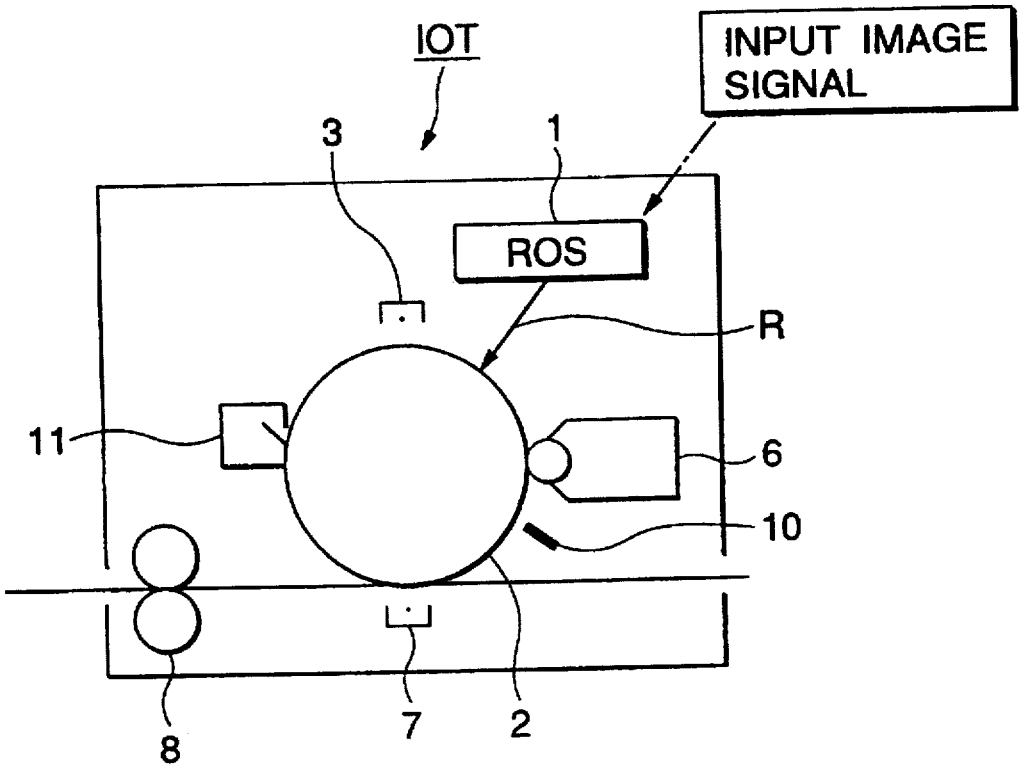
FIG. 2 schematically shows an image output terminal of the embodiment.

The schematic of an image output terminal (IOT) of the image forming apparatus is shown in FIG. 2. In FIG. 2, an image reader section and an image processing section are omitted. Only the image output terminal IOT, constructed on the basis of the xerographic process, is illustrated in the figure.

In the image forming process, an image signal comes from the image reader section (not shown) or a computer (not shown), and it is properly processed by the image processing section (not shown). The input image signal properly processed is inputted to a laser output unit 1. In the laser output unit 1, the image signal modulates a laser beam R. The modulated laser beam R raster scans the surface of a photoreceptor 2.

The surface of photoreceptor 2 has uniformly been charged by a scorotron charger 3. When the thus-charged photoreceptor 2 is scanned with the laser beam R modulated by the input image signal, a latent electrostatic image is formed on the photoreceptor 2. The latent electrostatic image is representative of an original image contained in the input image signal. The latent electrostatic image is developed into a toner image by a developing unit 6. The toner image is then transferred onto a paper (not shown) by a transfer unit 7. The transferred toner image is fixed onto the paper by a fixing unit 8. Thereafter, the photoreceptor 2 is made clean by a cleaner 11, to thereby complete one cycle of the image forming process. Reference numeral 10 designates a development density sensor for detecting the density of developed image patches (to be described layer) located outside the image forming area of the photoreceptor 2.

(2) Developed Image Patch Formation and their Monitoring

Figure 3:
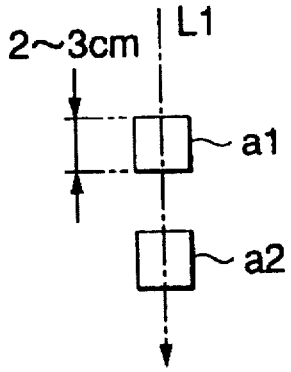
FIG. 3 schematically shows density patches in the embodiment.
Figure 4:
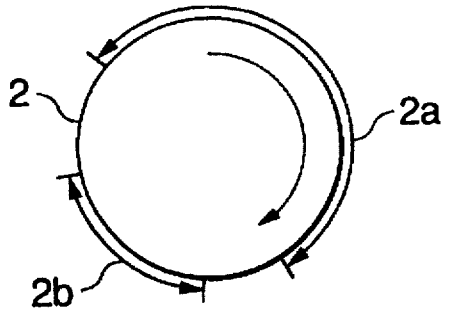
FIG. 4 schematically shows an area of a photoreceptor where the density patches are formed.

The developed image patches and a monitor for the patches, which are used in the present embodiment, will be described. The developed image patch is used for monitoring an optical density of an output image. Two types of the developed image patch, a solid (dot coverage of 100%) density patch al and a highlight (dot coverage of 20%) density patch a2, are used in the embodiment (FIG. 3). The solid density patch al and the highlight density patch a2 are each a square of about 2 to 3 cm wide and high, and located outside an image area on the photoreceptor 2 (FIG. 3). As shown in FIG. 4, the solid density patch al and the highlight density patch a2 are successively formed on an empty area 2*b*, after a latent electrostatic image is formed on an image area 2*a*.

The density sensor 10 is composed of an LED part for emitting light to the surface of the photoreceptor 2 and a photo sensor for receiving regular reflection light or diffuse reflection light from the surface of the photoreceptor 2. A line L1 (FIG. 3) is a detection line of the development density sensor 10. The solid density patch al and the highlight density patch a2 are arrayed on the line L1, and successively move past the density sensor 10.

Figure 5:
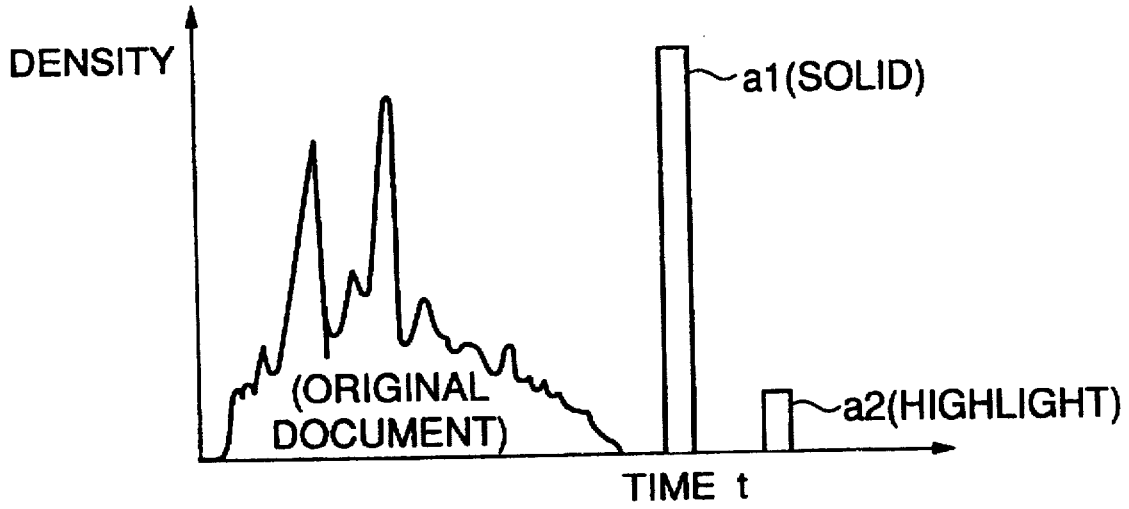
FIG. 5 shows an example of a waveform of an output signal of a development density sensor in the embodiment.

A variation of density represented by an output signal of the density sensor 10 is shown in FIG. 5. As shown, a density signal based on an image on an original document first appears, and then density signals based on the solid density patch a1 and the highlight density patch a2 appear. The solid density patch a1 and the highlight density patch a2 are not transferred onto the paper since these are located outside the image area, and these are erased when passing the cleaner 11.

The reason why the density on the developed image patch is sensed in the present embodiment is that the density on the developed image patch has a high correlation with the density of a fixed image (final image) to be used by users, and that it can be removed by the cleaner 11. The developed image patch may be formed on the image area if it is formed thereon at the timings that are different from the image forming timings.

(3) Configuration of Control Unit

FIG. 1 is a block diagram showing an arrangement of a control unit 20 for controlling the scorotron charger 3 and the laser output unit 1 in the image forming apparatus. In the figure, reference numeral 21 designates a density adjusting dial, which is set by an operator at a value corresponding to a desired or target density. A set density value of the density adjusting dial 21 is inputted to a converter 22. In the converter, the density value is converted into a value (any of the values from "0" to "250" in the embodiment) of the output signal of the density sensor 10. A desired or target density outputted from the converter 22 is stored in a control quantity memory 23. The control quantity memory 23 further stores a tolerable error value.

A density comparator 24 compares the output signal of the development density sensor 10 with the output signal of the control quantity memory 23. The tolerable error value, which is stored in the control quantity memory 23, is referred to in this comparison. The output signal of the density sensor 10 is supplied to a control rule retrieval unit 30 if a difference between them is within a tolerable value, and to a control case memory 25 if it is out of the tolerable value.

The control case memory 25 stores control cases. Each control case consists of a set of three types of quantities, i.e., a status quantity, an operation quantity, and a control quantity. The reason why the control cases are stored is that a variety of density controls will be performed on the basis of the past control cases stored in advance. This control procedure is called a case based inference.

The "status quantities" to be stored in the control case memory 25 may be a degradation by aging, and temperature and humidity which have great influences on the xerographic process. These status quantities are almost constant within a limited period of time. Therefore, in the present embodiment, time (date, and hour, minute and second) of occurrence of a case is used instead as the status quantity. If the cases occur at time points falling within a preset unit of time (for example, 3, 5, or 10 minutes), the status quantity is considered to be constant. This is based on the anticipation that if the time points of two cases are close to each other, the two cases are under approximately the same conditions of temperature and humidity, and have approximately the same aging degradation. The time data representative of the case occurrence time is supplied from a clock timer 40 (FIG. 1) in the present embodiment.

The "operation quantities" includes the quantities of adjustment of the parameters to change an output value of an object to be controlled. In the embodiment, two parameters are used, a grid voltage set value (0 to 255) for the scorotron charger 3 (this set value will be referred to as a scoro set value), and a laser power (LP) set value (0 to 255). These two quantities are used for the reasons that the final image density to be controlled contains a solid density and a highlight density, and that the scoro set value and the LP set value have high correlation with the solid density and the highlight density.

The scoro set values and the LP set values are stored in a operation quantity memory 32. These values that are specified by an output signal of an operation quantity correction calculation unit 31 are read out of the operation quantity memory 32. A scoro set value that is read out of the operation quantity memory 32 is supplied to a grid power source 15. In response to this, the grid power source 15 applies a voltage that is dependent on the scoro set value, to the scorotron charger 3. An LP set value that is read out of the operation quantity memory 32 is supplied to a light-quantity controller 16. In response to the LP set value, the light-quantity controller 16 supplies a laser power that is dependent on the LP set value to the laser output unit 1.

The "control quantity" to be supplied to the control case memory 25 is contained in an output signal of the development density sensor 10. Thus, the control cases as tabulated below are stored in the control case memory 25.

TABLE 1

| Control case No. | Status quantity Date/hour/minute /second | Set value LP set value | Set value Scoro set value | Sensor output value Solid | Sensor output value High-light |
|---|---|---|---|---|---|
| Case 1 | 940401120010 | 83 | 130 | 185 | 23 |
| Case 2 | 940401120025 | 102 | 121 | 176 | 15 |
| Case 3 | 94b401120040 | 154 | 98 | 195 | 33 |
| Case 4 | 940402090005 | 148 | 115 | 185 | 30 |
| Case 5 | 940402090015 | 146 | 110 | 175 | 19 |
| Case 6 | 940402090025 | 147 | 118 | 180 | 20 |
| ... | ... | ... | ... | ... | ... |

In Table 1, for example, the details of case 1 are: the status quantity (case occurrence time) is 12:00:10, Apr. 1, 1994;

the LP set value, "83"; the scoro set value, "130"; the solid portion control quantity, "185"; the highlight portion control quantity, "23". The details of the case 4 are: the status quantity is 09:00:05, Apr. 2, 1994; the LP set value, "148"; the scoro set value, "115"; the solid portion control quantity, "185"; the highlight portion control quantity, "30".

A status quantity comparator 26, a cluster memory 27, and a control rule calculation unit 28 cooperate to extract a control rule while referring to the control cases that are stored in the control case memory 25. The functions of these blocks will be described later.

A control rule memory 29 stores a plural number of rules that are computed by and outputted from the control rule calculation unit 28. In response to a control rule request from the control rule retrieval unit 30, the control rule memory 29 returns a requested control rule to the control rule retrieval unit 30. In this case, the control rule retrieval unit 30 requests the control rule memory 29 to return such a control rule that is based on a density difference supplied from the density comparator 24 and an operation quantity (i.e., an LP set value and a scoro set value) supplied from the operation quantity memory 32.

The operation quantity correction calculation unit 31 computes a correction value of the operation quantity by using the retrieved control rule, and supplies the computed correction value to the operation quantity memory 32. The operation quantity memory 32 supplies an operation quantity that corresponds to the operation quantity correction value, more exactly, an LP set value and a scoro set value, to the grid power source 15 and the light-quantity controller 16.

A reference-patch signal generator 42 instructs the image output terminal IOT to form a solid density patch al and a highlight density patch a2. At a patch forming timing, the reference-patch signal generator 42 outputs a calibration reference patch signal to the image output terminal IOT. In response to this signal, the image output terminal IOT forms a solid density patch al and a highlight density patch a2.

An I/O adjustor 41 generates operation timings of the reference-patch signal generator 42. The I/O adjustor 41 monitors a time signal outputted from a clock timer 40, and generates operation timings of the reference-patch signal generator 42 so that the solid density patch al and the highlight density patch a2 are formed at preset locations on the photoreceptor 2.

Operation of Embodiment (1) Initial Setting

The operation of the image forming apparatus thus constructed will be described. An initial setting process (called a setup process) will first be described. To begin with, an engineer properly sets a scoro set value and an LP set value selected as control parameters. The control unit 20 forms a solid density patch al and a highlight density patch a2, measures these patches by the density sensor 10, and stores the results of the measurement as control cases into the control case memory 25.

Thus, a first control case (case 1) is stored into the control case memory 25.

In a similar way, two control cases are further stored into the control case memory 25 while the scoro set value and the LP set value are varied. Thus, the engineer stores a total of three control cases into the control case memory 25 in the setup process of the control unit (within a unit time period where the status quantities are equal).

The number 3 means the number of objects to be controlled plus one; in this embodiment, 2 (the solid density and highlight density)+1. If required, the number of the control cases may be more than 3. When the three control cases (the number of control objects plus one) set in the setup process are stored into the control case memory 25, the contents of the storage are supplied to the control rule calculation unit 28, through the status quantity comparator 26 and the cluster memory 27. The control rule calculation unit 28 determines a control rule by a computing process, to thereby complete the initial setting process in this embodiment. The control rule in this case is extracted as control case planes as shown in FIG. 6.

Figure 6:
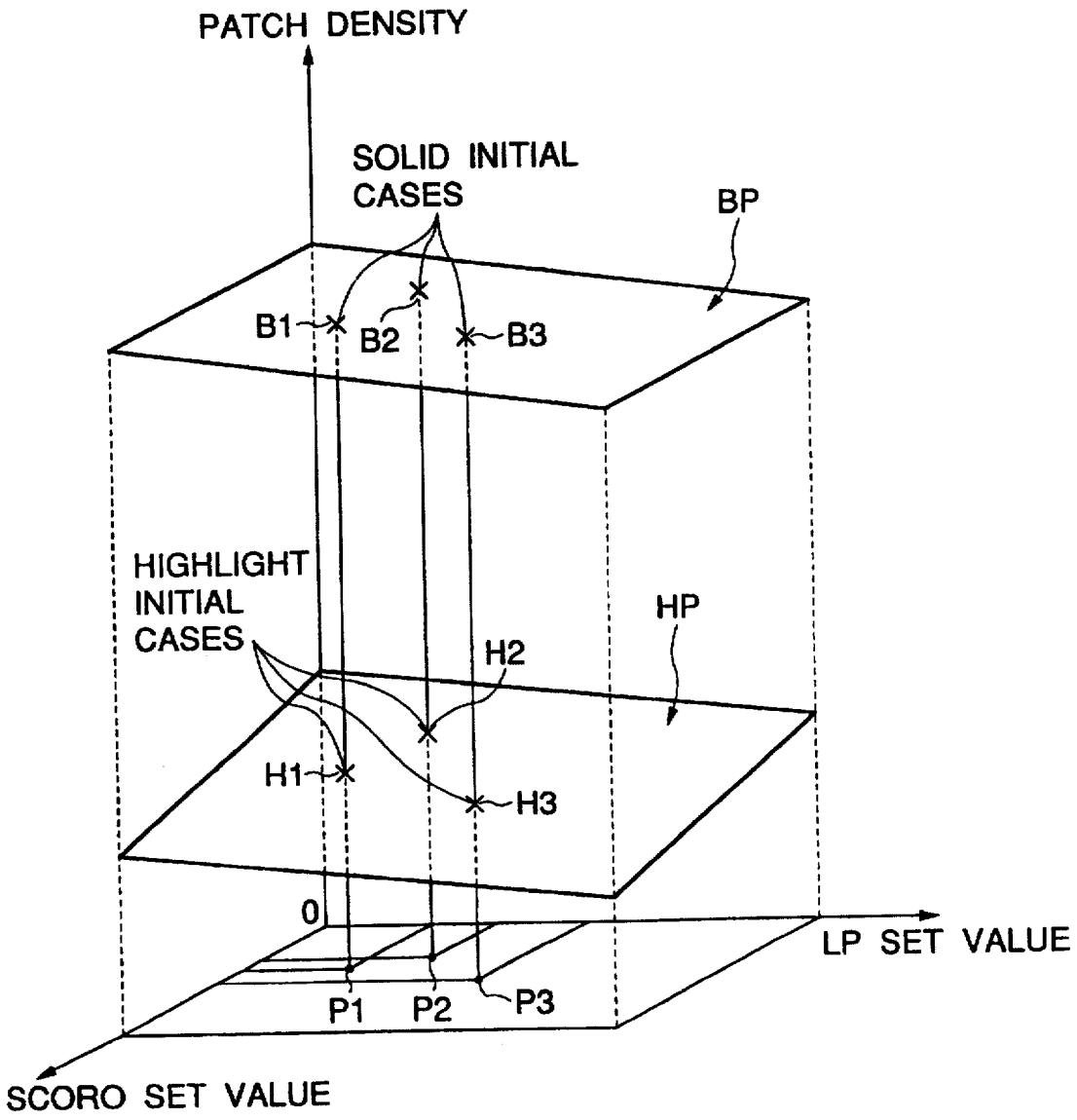
FIG. 6 is a conceptual diagram illustrating control case planes that are formed in the embodiment when the image forming apparatus is started up.

In FIG. 6, P1, P2 and P3 designate points indicative of the combinations of the scoro set value and the LP set value on the three control cases in the initial setting process. In the figure, H1, H2, and H3 are points indicative of highlight densities (detected densities of the highlight density patch), which correspond to the points P1, P2 and P3; B1, B2 and B3 are points indicative of solid densities (detected densities of the solid density patch), which correspond to the points P1, P2 and P3. A plane containing the points B1, B2, and B3 is referred to as a solid case plane BP, and a plan containing the points H1, H2, and H3 is referred to as a highlight case plane HP. Where the status quantity is not varied, points indicative of solid densities created when the scoro set values and the LP set values are varied are all within the solid case plane BP. Where the status quantity is not varied, points indicative of highlight densities created when the scoro set values and the LP set values are varied are all within the highlight case plane HP. Thus, the solid case plane BP and the highlight case plane HP indicate all of the cases where the status quantity is not varied. In other words, these planes indicate the control rule on the solid density and the highlight density in the initial state of the image forming apparatus.

The reason why the three control cases are stored in the initial setting process follows. When the number of the control objects is n, (n+1) number of the control cases are required. The plane representative of the control cases is an n-dimensional plane of an (n+1)-dimensional space. Therefore, to uniquely determine the n-dimensional plane, (n+1) number of data points are required. Since this embodiment uses the two control objects, i.e., the solid density and the highlight density (n=2), three control cases are required.

(2) Actual Operation

[Basic Operation]

An actual control operation of the image forming apparatus of the embodiment will be described. In the operation to follow, it is assumed that the control rule is determined as in the initial setting process already referred to, and the image forming apparatus is operated for control on the day after.

Figure 7:
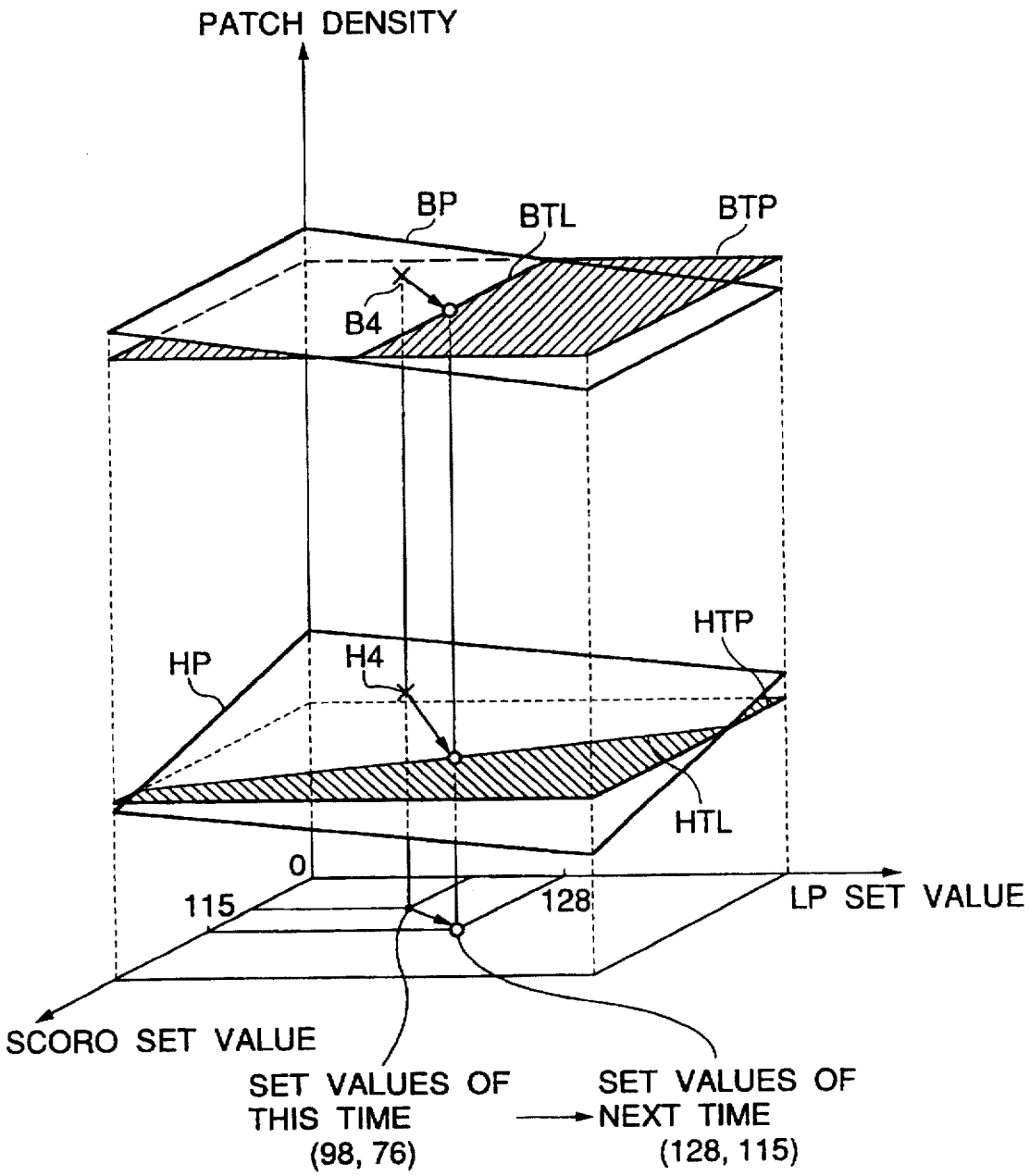
FIG. 7 is a conceptual diagram illustrating an inference method for controlling solid and highlight densities in the embodiment.

When a power switch (not shown) of the image forming apparatus is turned on, the setup operation automatically starts. In the setup operation, the set values previously set up are used as they are, and a solid density patch al and a highlight density patch a2 are formed. The densities of these patches are measured by the density sensor 10. In this instance, densities detected by the development density sensor 10 are plotted in the control case space, on the assumption that the LP set value is "98", and the scoro set value is "76". If the densities of the solid density patch a1 and the highlight density patch a2 are B4 and H4, these are plotted as shown in FIG. 7. By seeing the control case space, the contents of the present control defined by the stored control cases are confirmed.

The plotting of the data is carried out by the control rule retrieval unit 30 (FIG. 1). The control rule retrieval unit 30 plots the data in the control case space that is formed in the initial setting process and stored in the control rule memory 29, on the basis of the densities B4 and H4 from the density comparator 24 and the LP set value of "98" and the scoro set value of "76" that come from the operation quantity memory 32.

The control case plane is formed by plotting output values produced when certain values are set in a certain state. Accordingly, in a case where the state is varied and output values are changed from those produced in the previous state, the present control case plane is not coincident with that in the previous state. A case where the control contents in the present setup process are the same as plotted (without any effective spatial difference) in the control case plane that was formed in the setup process yesterday, as in the above-mentioned case, indicates that the present status (all of the factors having great influence on the xerographic process, such as temperature, humidity, a degree of aging, and the like) of the image forming apparatus is substantially equal to the status thereof in the setup process. The phrase, "without any effective spatial difference", means that the control is carried out on the assumption that the present control case plane is coincident with the control case plane formed in the setup process, and the difference of the image density actually outputted and a target density is within a tolerable error quantity.

Subsequently, a print density that is initially set or a target print density that is set by a user is converted into a corresponding value of the output signal of the development density sensor. The target density output value thus obtained is plotted as a target density plane in the control case space. The setting of the target density plane is carried out in the following way in the hardware of the image forming apparatus.

An adjustment value outputted from the density adjusting dial 21 is converted by the converter 22, and the converted value is stored into the control quantity memory 23. The target density value is transferred from the memory 22 to the control rule retrieval unit 30 by way of the density comparator 24. The control rule retrieval unit 30 plots a plane of the target density value in the control case space, and superimposes the target density value plane (parallel to the plane containing the scoro set value axis and the LP set value axis) on a solid case plane BP and a highlight case plane HP that are read out of the control rule memory 29.

Through the above process, the solid case plane BP on the solid density, the highlight case plane HP on the highlight density, the solid target density plane BTP, and the highlight target density plane HTP are plotted in the control case space, as shown in FIG. 7. In the thus-plotted control case space, the control contents that are set up in the setup process are additionally plotted.

As seen from FIG. 7, if the present control contents are plotted on a solid target achieving line BTL where the solid case plane BP intersects the solid target density plane BTP, the solid target density is achieved. If the present control contents do not line on the target achieving line, the set values are altered, viz., corrected, and those are combined so as to lie on the solid target achieving line BTL. If so done, the solid target density will be achieved in the next image output.

Similarly, the highlight target density will be achieved in the next image output by combining the set values so that these values are plotted on the highlight target achieving line HTL. To control simultaneously both the solid density and the highlight density to the target densities, the solid target achieving line BTL and the highlight target achieving line HTL are projected onto the plane defined by the LP set value axis and the scoro set value axis, and an LP set value and a scoro set value at the resultant intersections are used. In the instance of FIG. 7, the solid and highlight target densities can simultaneously be achieved by correcting the present set values (98, 76) to (128, 115) as the next set values. In this way, the next LP set value and the next scoro set value that are for achieving the target values of the solid and highlight densities, can be determined by using the setup data.

The process of computing the next set values is carried out by the operation quantity correction calculation unit 31, and the results of the computing process are transferred to the operation quantity memory 32. As a result, the operation quantity memory 32 produces signals representative of a new scoro set value and a new LP set value for transfer to the grid power source 15 and the light-quantity controller 16. Subsequently, the LP set values and the scoro set values that are optimal for the target densities are set in similar ways, so that an exact image density control is carried out.

[Generation of Cluster]

The basic operation of the image forming apparatus for controlling an image density to a target image density is performed as described above. In actual situations, the control contents when the image forming apparatus is operated are not always plotted on the solid and highlight case planes (without any effective spatial difference), however. The physical mechanism of this follows. When temperature and humidity vary and the aging progresses, the toner charge quantity, the charging characteristic of the photoreceptor, and the like vary. In this situation, the image density is greatly varied, if the set values of the laser power and the scorotron grid voltage are not varied. An example is such that the image density becomes high when temperature and humidity are high, and it becomes low when these are low. Thus, when temperature, humidity, a degree of aging, and the like at the time of image density control are different from a group of already gathered and stored control cases by the quantities thereof in excess of predetermined ones, the status quantity data will be plotted in a coordinate space greatly apart from the solid and highlight control case planes.

In such a situation, if a certain control case plane is directly used for the present control rule, an error in the inference is great. The reason for this is that the image reproduction mechanism has physically been influenced and the control case plane has been varied, as described above.

To cope with this, the present invention additionally stores the control cases when the status is varied, and progressively forms new control case planes containing control case groups that are adapted for new status. Accordingly, the number of the control case planes is gradually increased from one control case plane of the setup data with use of the image forming apparatus. An example is that a control case plane of a group of control cases in a status A, a control case plane of a group of control cases in another status B, and so forth are additionally used to increase the number of the control case planes. These control case groups are referred to as clusters, i.e., cluster A, cluster B, and so forth.

Judgement as to whether or not the control cases are to be added is made by the result of the density control, which is determined by using a developed image patch formed after the density control is carried out.

To be more specific, the differences between the target densities and the actual densities of the solid developed image patch and the highlight developed image patch are detected, and it is checked as to whether or not the density differences are within the tolerable ranges. In the present embodiment, the tolerable range of the solid density is within 3 of the color difference, and the tolerable range of the highlight density is within 1 of the color difference. These tolerable ranges are properly selected in accordance with the target accuracy of the system.

If the difference between the target density and the actual density of the solid developed image patch and the difference between the target density and the highlight developed image patch are both within the tolerable ranges, the control unit enters the next density control operation. If either of the differences is out of the tolerable range, its contents, viz., the control case, is additionally stored into the control case memory 25.

A new control case is stored in the following manner. The density comparator 24 (FIG. 1) determines that the density difference is in excess of a tolerable value, and the output signal of the development density sensor 10 that is produced at that time is transferred to the control case memory 25. The control case memory 25 stores the additional control quantity, together with a status quantity and an operation quantity, in the form of a set of these quantities. The status quantity comparator 26 compares the time data of the new case additionally stored in the control case memory 25 with the time data of the control case of the latest cluster for checking as to whether both cases are similar in status. More specifically, the comparator compares the time data of the latest cluster as a group of control cases with the time data of the new control case. If the difference between the time data is within a preset value, the control unit considers that both cases are similar in status. If it exceeds the preset value, the control unit considers that both cases are not similar in status.

If both cases are similar in status, the control case is stored into the cluster memory 27 in order to add the control case to the latest cluster. At this time, the control rule calculation unit 28 computes a control case plane containing the additional control case, and transfers a coefficient representative of this new plane to the control rule memory 29.

A method of correcting the control rule when the number of the control cases is increased will be described. As already described, to control n control objects, an n-dimensional plane of an (n+1) dimensional space is required. To uniquely determine the n-dimensional plane, (n+1) number of data are required. For this reason, in the present embodiment, three control cases are used in the setup process. In other words, the use of more than (n+1) control cases will statistically provide a more reliable case group. On the basis of this fact, the control rule calculation unit 28 determines the plane by a computing method, such as the method of least squares while using the additional control case and the previously stored control cases (viz., data of more than (n+1) sets). In this case, an averaging method may also be used in place of the method of mean squares. Any other method may be used if it can determine the n-dimensional plane using the control cases, as a matter of course.

If the status quantity comparator 26 determines that the status of the control case that is stored into the status quantity comparator 26 is not similar to the status of the control case of the latest cluster, a new cluster is formed to contain the new control case. The new cluster is transferred to the cluster memory 27, and the control rule calculation unit 28 produces a new rule (plane) by a computing process. Only the coefficients representative of the plane computed by the control rule calculation unit 28 is stored into the control rule memory 29, to thereby minimize an increase of the memory capacity of the memory.

[Memory Management]

Thus, the control cases are accumulatively stored as the image forming apparatus undergoes various experiences, and the number of the clusters are also correspondingly increased and the memory is full of the data of the control cases and the clusters. To cope with this, the present embodiment is arranged such that the control cases and the clusters are stored in separate memory areas, and those are successively erased in sequence of the date of gathering and forming them.

The reason why such an arrangement is used follows. The present status is the result of changing a past status with time, and the control cases and clusters become invalid in the order of the gathering ana probability thereof. Accordingly, a probability that such old control cases and clusters will be used is extremely small, and a less necessity of storing them is present. In a case where the similarity of the status quantities is judged by the date, as in the present embodiment, when a given period of time passes and a cluster is completed, viz., the control rule for the cluster has been extracted, the control cases belonging to the cluster can be erased.

Such an arrangement that the control cases contained in the cluster are erased when the cluster is completed, realizes an extreme reduction of the required memory capacity. In the present embodiment, each control case consists of three elements. The cluster also consists of three elements, the inclinations of the respective setting value axes, and the intercept of the density axis. It is assumed that the memory areas of these elements are designed so as to have the same size of n bits. As recalled, three control cases are required for forming one cluster. Then, it is seen that to store all of the elements, the memory area of 3×4× n bits is required. In this case, if the control cases are erased when the cluster is completed, the required memory capacity is 2×1× n bits. This is ¼ of the memory capacity when the control cases are not erased. The control case erasure method is effective particularly when it is applied to a case where a number of clusters are stored. Accordingly, when one cluster contains ten control cases, the required memory capacity is reduced to 1/11; when one cluster contains 100 control cases, it is reduced to 1/101. Thus, the memory is remarkably saved.

Thus, the memory can be considerably saved by the control case erasure method, but the number of the clusters is increased with time, and the apparatus will be short of the memory. The shortage problem of the memory can be solved by erasing the control cases and the clusters in the order of their gathering and forming date, however.

[Control Using Clusters in Combination]

The image forming apparatus having been operated under various conditions will have a variety of clusters accumulatively formed. Whenever the conditions under which the image forming apparatus is operated are varied, it is not always necessary to form a new cluster by additionally using new control cases. In a case where clusters for high and low temperature already exist, and the image forming apparatus is now operated at medium temperature in a state that other factors than temperature are substantially equal, a combination of the high and low temperature clusters will provide a satisfactory accuracy of the density control. In this case, the present embodiment constructs a new case control plane containing the present control contents therein, on the basis of the distance between the present control contents and the past control case planes, and uses this new plane as a control rule that is the best for the present status.

Figure 8:
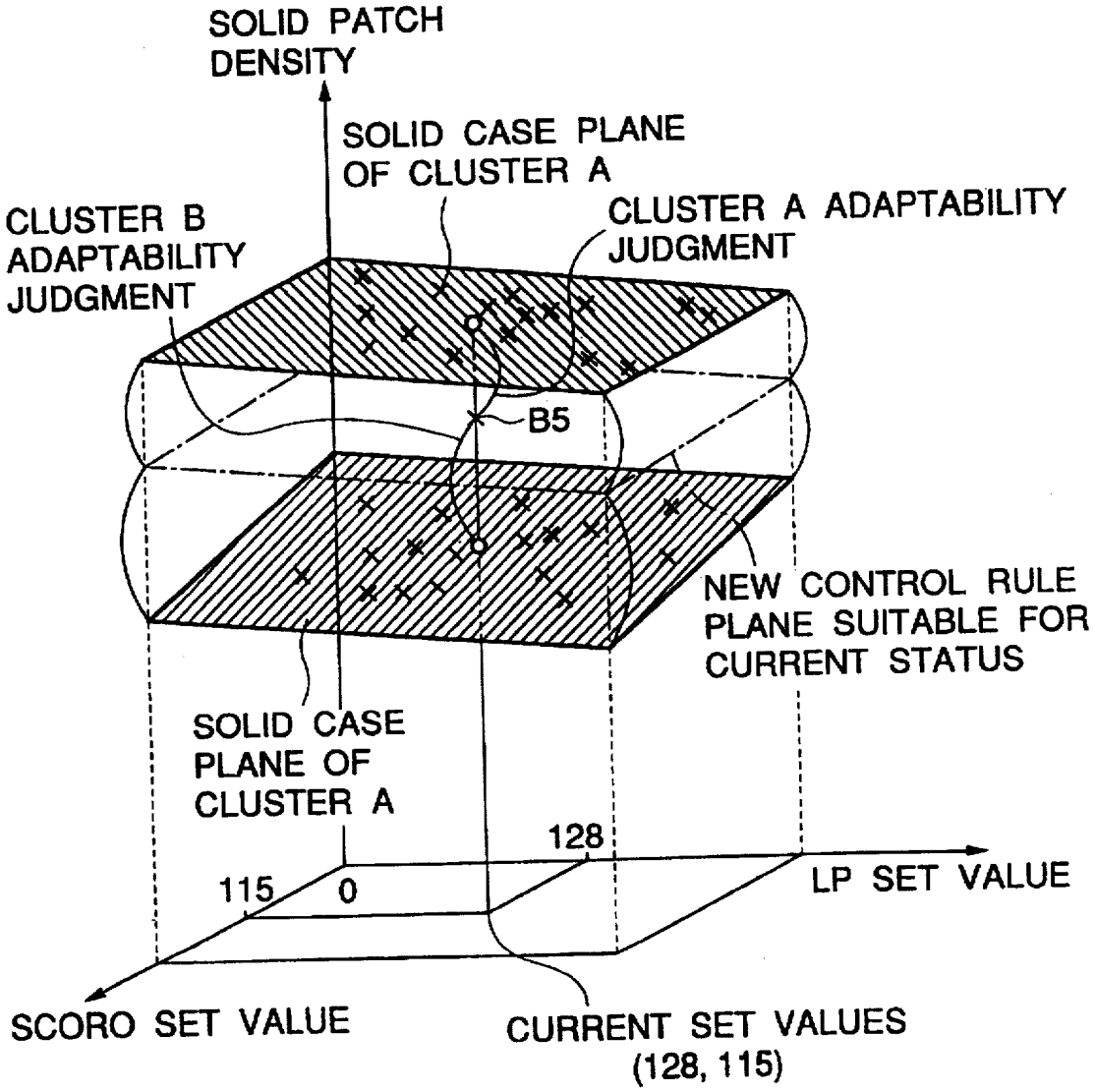
FIG. 8 is a conceptual diagram illustrating how a new control rule plane is formed from a plurality of existing clusters by use of adaptabilities.

The plane construction based on the combination of the high and low temperature clusters will be described with reference to FIG. 8. FIG. 8 shows a control case space containing solid case planes of clusters A and B. In the coordinate space, a point B5 plotted anew belongs to neither of the solid case planes. A distance between a point indicative of the present control contents in the coordinate space, i.e., the point B5, and each of those control case planes is computed. Then, the reciprocals of the distance values are computed, and the results are normalized. The sum of the reciprocals of the distance values is made equal to 1. The normalized value is defined as an adaptability expressed in percent. The inclinations of the case planes with respect to the coordinate axes are weighted by the adaptability, and summed. The quantity of the sum is used as the inclinations of a new control case plane that is adaptable for the present status, with respect to the coordinate axes. Further, the plane is set at a height (the intercept of the density axis) at which the plane contains the present control contents.

The above-mentioned process is carried out in such a case where it is impossible to retrieve a control case plane having the adaptability of 100%. The 100% adaptability is equivalent to "the case where the control contents may be plotted in the control case plane without any effective spatial difference" as already mentioned.

The above-mentioned process is carried out by the control rule retrieval unit 30 in the following manner. A point representative of operation quantities supplied from the operation quantity memory 32 and a value of the density sensor 10 that is supplied from the density comparator 24, is plotted in a coordinate space. The control planes of the clusters are successively read from the control rule memory 29, and distances between the newly plotted point and the control case planes. The distance is a difference between the control quantity computed by substituting the operation quantity into the expression of the control rule, and the actually measured control quantity, and is not always the shortest distance between the plane and the point. An adaptability of the plane is computed by using the distance value thus obtained, and the inclinations of the control case planes with respect to the coordinate axes are weighted by the adaptability, and the resultant inclinations are summed. A control case plane having the axes thus inclined is used as a new control case plane, and the height (the intercept of the density axis) of the new control case plane is adjusted so that the plotted point is contained in the plane. Then, the next LP set value and the scoro set value are obtained by using the control case plane thus formed as in the case of FIG. 7.

When an image forming apparatus is immediately after it is set up, it is operated not for a long time, or it has a less number of image forming operations, it has only one control case plane that is formed when it is set up. The case having only one control case plane may be handled as the case of a plural number of control case planes. In this case, an adaptability of the plane is 1 (100%), and the inclination of the plane is not varied. A control case plane that is formed by translating, along the density axis, the control case plane formed at the time of the system setup to a position where the present control contents are contained in the plane, is the control case plane used this time.

When it is expected that the density control based on the past control cases will secure a satisfactory control accuracy in the subsequent density control if a new control case plane is virtually constructed by using the above-mentioned adaptability, that is, when the density comparator 25 determines that the density difference exceeds a tolerable value, a new cluster is formed as described above.

Advantages of Embodiment

Advantages of the embodiment having the above configuration and control procedure will be described hereinafter.

(1) The density control method according to the above-mentioned embodiment of the present invention uses the gathered control cases as mentioned above. Because of this, there is no need of using other physical quantity sensors than the development density sensor, and there is eliminated the data gathering and analyzing work by the engineer that is done before the density control. In other words, the number of required sensors and the number of the steps of developing the image forming apparatus are reduced, and hence the cost to manufacture is reduced. To realize the density control as of the above-mentioned embodiment, the conventional art which uses the control method based on the physical mechanism requires the following complex and time-consuming procedure. a) Physical quantities, such as charge potential and exposure potential, are measured by potential sensors. b) A development potential (difference between the exposure potential and the developing bias voltage) and a cleaning potential (difference between the charge potential and the developing bias voltage) are obtained using the measured physical quantities. c) An optimum developing potential to realize a desired solid density is computed using the relationship between the solid density gathered in advance and the developing potential. d) A quantity of change of the highlight density that is caused by converting the developing potential to the optimum developing potential, is computed. e) A highlight density error to be corrected, which contains the change of the highlight density, is computed using the relationship between the highlight density and the cleaning potential that are gathered in advance, to thereby determine a charge potential and an exposure potential. f) An LP set value and a scoro set value to be set in the next image forming process are determined by the relationship between the charge potential and the scoro set value that are gathered in advance and such a relationship between the exposure potential and the LP set value that is adaptable for the charge potential already gathered. Further, the work to gather data in advance must be done in various temperature and humidity conditions since the xerographic process depends greatly on temperature and humidity.

(2) In the present embodiment, it is not always necessary to sense a status in which the image forming apparatus is placed since s substitution (sampling time) of the status quantity may be used. This fact implies that the density control is possible if nothing is known about the physical mechanism on the image formation, and hence the present invention is applicable to any other image forming process than the xerographic process.

An additional advantage of the embodiment lies in that a desired parameter can be used for the control actuator. Such a parameter that, in the conventional art, cannot be used since a sensor for gathering it is not yet marketed or because of the limit of cost of the product, can be used since its set value can directly be handled in the present embodiment.

(3) It is noted that the image forming apparatus of the embodiment can be set up (initial setting) by merely entering control cases of at least "n+1" in number. In other words, any special technique or instrument is not required for setting up the image forming apparatus. If these control cases of "n+1" are greatly deviated from a desired density, the deviation does not affect any adverse influence on the subsequent control performance of the image forming apparatus. The reason for this is that the image forming apparatus per se is able to form a new cluster at need, viz., a new rule adaptable for a new status.

In contrast to the above function, in the conventional density control based on the neural network, when the teacher data on the control rule is incorrect, the network will learn the incorrect data and make an inference by using the incorrect data. Further, it has no function to automatically make an additional learning or a second learning. Thus, the control performances of the conventional density control are unsatisfactory. In another conventional art based on the fuzzy inference, an improper tuning of the try an error by the engineer will provide unsatisfactory control performances. From the comparison of the invention with those conventional art, it will be seen that the invention has outstanding advantages.

When the image forming apparatus of the embodiment undergoes a first status that it has never experienced, it can extract a new control rule adaptable for the new status by the printing operations at least "n+1" times. Thereafter, when the image forming apparatus encounters the same status, it automatically selects the control rule and controls the image density exactly. Thus, the image forming apparatus can cope with a variation of the status with time without any gathering of data in advance. In other words, the image forming apparatus can follow up a varied status even if the status has been varied with time.

On the other hand, the conventional art must perform the printing operations several tens or hundreds of thousands times to gather the data varying with time, in developing the image forming apparatus. The present invention succeeds in reducing this tremendous time- and labor-consuming work of gathering such data to zero. Great attention should be paid to this outstanding effect.

The conventional art suffers from the following problems. The thus-gathered data are not always valid for every image forming apparatus since the ambient conditions at the places where the image forming apparatuses are operated are not uniform. When the image forming apparatus is operated in such ambient conditions that could not be reckoned with in the stage of the in-advance data gathering, a change, which is out of the designer's anticipation, occurs to the time varying data, the control rules that already exist are invalid for this situation, and the image forming apparatus cannot control the image density as intended. On the other hand, the image forming apparatus of the invention is normally operable in any ambient conditions without the in-advance data gathering and taking any measure for the ambient conditions that are different every image forming apparatus used. Thus, the image forming apparatus of the invention can cope with a density variation by aging in any situation where the image forming apparatus is used.

When component parts greatly influencing the image density, such as the photoreceptor or the developer, are replaced with a new one, this function enables the image forming apparatus to automatically adjust the image density to a desired one in conformity with the new part, by merely repeating the printing operation at least "n+1" times.

These adjusting work, which have been made by service engineers, are completely eliminated by the invention. Great saving of labor and its cost is realized. When a general user, not such a specialist as a service engineer, replaces the component parts with new ones, the image forming apparatus automatically optimizes the image density, to thereby form a quality image. Easy handling of the machine is realized.

Further, the concept of "adaptability" is applied to a plural number of clusters in the image forming apparatus of the present invention. With this concept, additional storage of new control cases into the memory is not always required when the image forming apparatus is placed in a new situation. Thus, the image forming apparatus of the invention can quickly copes with a new situation without repeating the printing operations "n+1" times and the memory for storing new control cases.

(4) Additionally, the invention allows the density control accuracy to be set to a desired level. In other words, a tolerable error quantity for the desired density can directly be set to a desired one. The image forming apparatus improves and alters the control rules, and forms new control rules on the basis of the tolerable error quantity set anew. Accordingly, the control by the image forming apparatus automatically reaches a required and satisfactory level of the control accuracy. Where the required and satisfactory level of the control accuracy is achieved, no storage of additional control cases is required, so that additional use of the memory capacity does not take place.

(5) Further, in the present invention, a proper quantity may be used for the status quantity or its substitution. Therefore, the density control may flexibly be constructed in accordance with the characteristic and the purpose of the image forming apparatus.

In the conventional image forming apparatus, the control algorithms must constructed separately when the aimed density control is changed to another, for example, to control the daily variation (the date is used for the category of the status quantity) or to eliminate a density variation, caused mainly by the cycle down and the cycle up (the number of prints is used for the category of the status quantity). On the other hand, the present invention does not need such a troublesome and labor-consuming developing work for constructing the control algorithms. Also in the status recognition by using humidity and temperature sensors, the present invention is directly used without any modification.

(6) An additional useful feature of the image forming apparatus of the invention is that the memory can be used most effectively. The image forming apparatus automatically ranks the data of control cases in order of their importance, and erases the data in the ascending order ranked, the data ranked at the lowest level, the data next to the former, and so on. Therefore, the storage of important data is secured even if the memory capacity of the memory is limited.

Modifications

It should be understood that the embodiment of the image forming apparatus according to the present invention may variously be modified as described hereinafter.

(1) In the above-mentioned embodiment, the image output terminal IOT is the monochromatic laser printer. It may be a multi-color laser printer or an analog copying machine. Additionally, an image output terminal of the ink jet type, not the xerographic type, may also be used.

(2) The sensor used in the embodiment of the present invention is a specific example, and it may be any type of sensor if it is capable of exactly sensing a density of the developed image patch. An object to be monitored may be any thing of which the density has a high correlation with that of the final image. Any of the developed image, the transferred image, and the fixed image, for example, may be monitored if the density of it has a high correlation with that of the final image to be used by the user.

(3) The embodiment uses two densities, the dot coverage of 100% by the solid density patch and the dot coverage of 20% by the highlight density patch. If required, only the density, which corresponds to the dot coverage of 50%, may be used as the control density. If more than two density patches are used, the density is controlled at multi-tone points. To independently control the multi-tone points, it is necessary to use the number of different control parameters that corresponds to the number of the multi-tone points.

(4) The density of the developed image patch is monitored in the embodiment. A reproduced image may directly be monitored for the same purpose. Another suitable physical quantity may also be monitored, as a matter of course.

(5) The developing bias set value is fixed in the embodiment. Such a modification that the laser power is fixed, while the set value of the grid voltage of the scorotron charger and the developing bias voltage are used as control parameters, is allowed. This is because the developing bias voltage has a high correlation with the solid density and the highlight density. For the same reason, another modification is allowed in which the set value of the grid voltage of the scorotron charger is fixed, while the laser power set value and the developing bias voltage are used as the control parameters.

Further, three tone points may be controlled using the three set values of the laser power, the developing bias voltage, and the grid voltage of the scorotron charger. These tone points are 100%, 50%, and 20% in dot coverage, for example.

(6) The image forming apparatus of the embodiment employs the developing unit of the two-component type. In this case, a toner density in the developer, i.e., a mixing ratio of toner and carrier, greatly influences a density of the developed image. For the image density control based on the toner density, the embodiment keeps the toner density substantially constant in a manner that the amount of supplied toner is controlled so as to be proportional to the number of pixels of an image to be outputted. The control of the toner density to the almost constant value may also be secured by monitoring the toner density by a sensor of the magnetic or optical type, commercially available and usually used.

The toner density being kept substantially constant suffices for the embodiment since the embodiment does not employ the method of actively controlling the toner density so as to have a desired image density. A variation of the toner density, if it is not large, can be absorbed by properly setting the control parameters (scoro set value and the LP set value.

In the image forming apparatus which uses the developing unit of the one-component type, the toner density is always 100%, and it does not directly influence the image density. The conventional toner management, which is based on the detection of the amount of toner left in the toner cartridge, empty or not, suffices for the embodiment.

(7) The control case, employed in the embodiment, consists of three quantities, the status quantity, the set values (operation quantities), and the output value (control quantity). Time is used for the status quantity. Accordingly, there is no need of using sensors for monitoring temperature and humidity.

Examples of the substitution of the status quantity are the number of prints after power on the day, the number of prints accumulatively counted from the day of first operating a new image forming apparatus, or the number of prints counted after the print button is pushed. This is because in some of the image forming apparatuses based on the xerographic process, the characteristic of the photoreceptor depends greatly on the number of prints. Of a series of prints that are produced by the image forming apparatus, first several prints are greatly different in image density from the subsequent prints. In this case, the use of the number of prints for the status quantity is very effectual.

Thus, the status quantity is not always some physical quantity sensed. A proper status quantity or its substitution may selectively be used in accordance with the characteristic of an image forming apparatus supposed.

Where there is no limit by cost and space in mounting sensors for sensing other status quantities, such as temperature and humidity, and a more precise density control is required, those sensors may be used for gathering the relative data. In this case, any special process and alteration of the image forming apparatus are not required.

Our experiment showed that the control cases, which belong to the category of the temperature and humidity variations, are automatically generated without the temperature and humidity sensors, and provision of those sensors are not required for the image forming apparatuses, if these are of the usually used type.

(8) Another method of acquiring control rules will be described. In the above-mentioned embodiment, the "plane" was used for acquiring the control rule. A "curved surface" of a higher order than the plane may be used for the same purpose.

As compared with the case of a curved surface, in the case of a plane, the control rule can be formed by at least three control cases. In a case where a further number of control cases are present, a statistical averaging of them will eliminate an adverse effect of a measurement error. It is noted here that the control rules per se are formed in accordance with an accuracy of the control rule in a complementary manner, and hence an overall control accuracy can be set at a desired level of accuracy. A model of the formation of the control cases is shown in FIG. 9.

For only a region that can be defined by a control case plane, the plane is used for defining the region. For a region that cannot be defined by the plane, another control case plane is generated anew. The generation of the control case planes is automatically continued till a desired control accuracy is gained.

Figure 9:
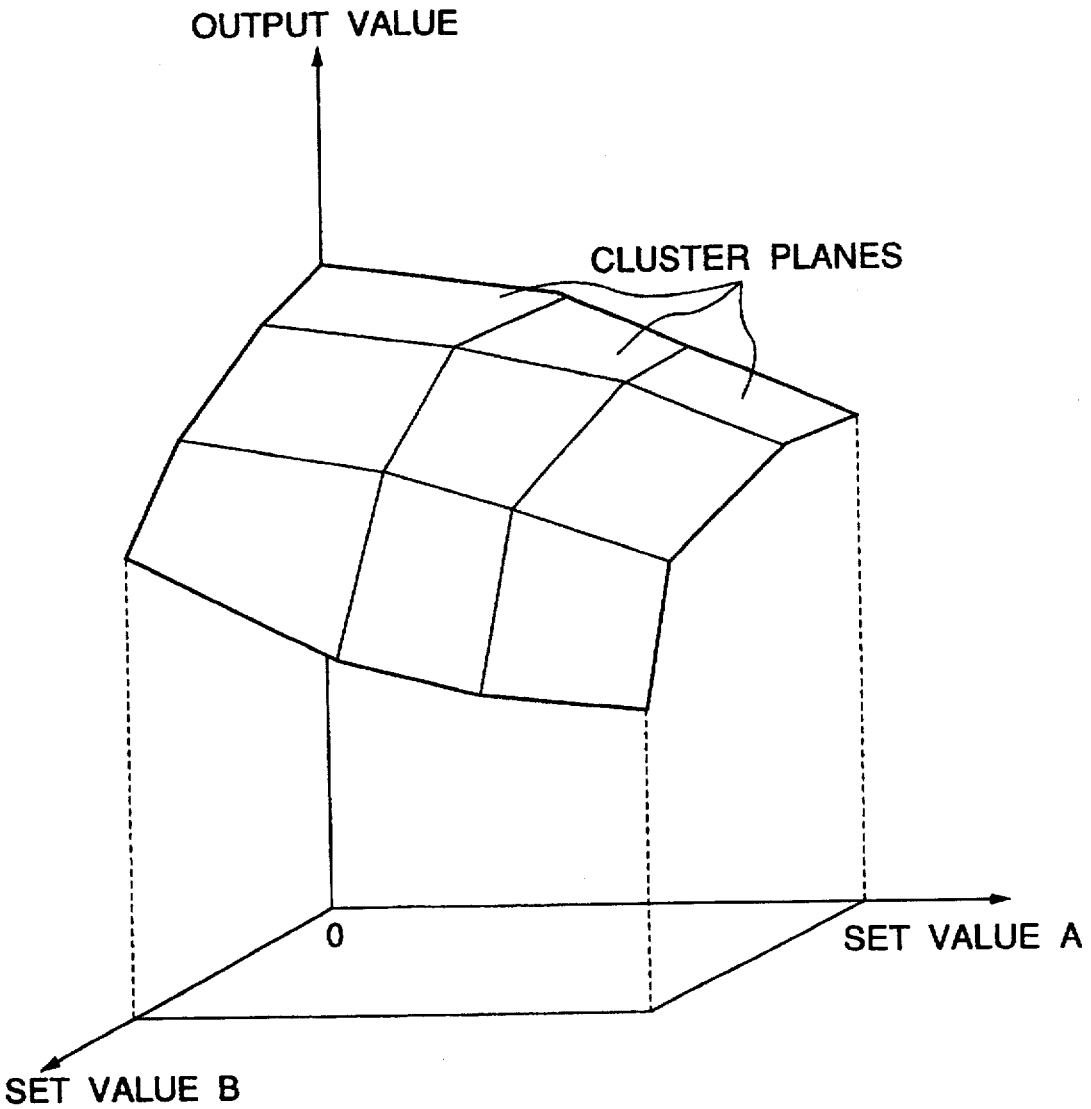
FIG. 9 schematically illustrates that a control rule of an arbitrary curved surface can be approximated by a plurality of control rules of planes.
Figure 10:
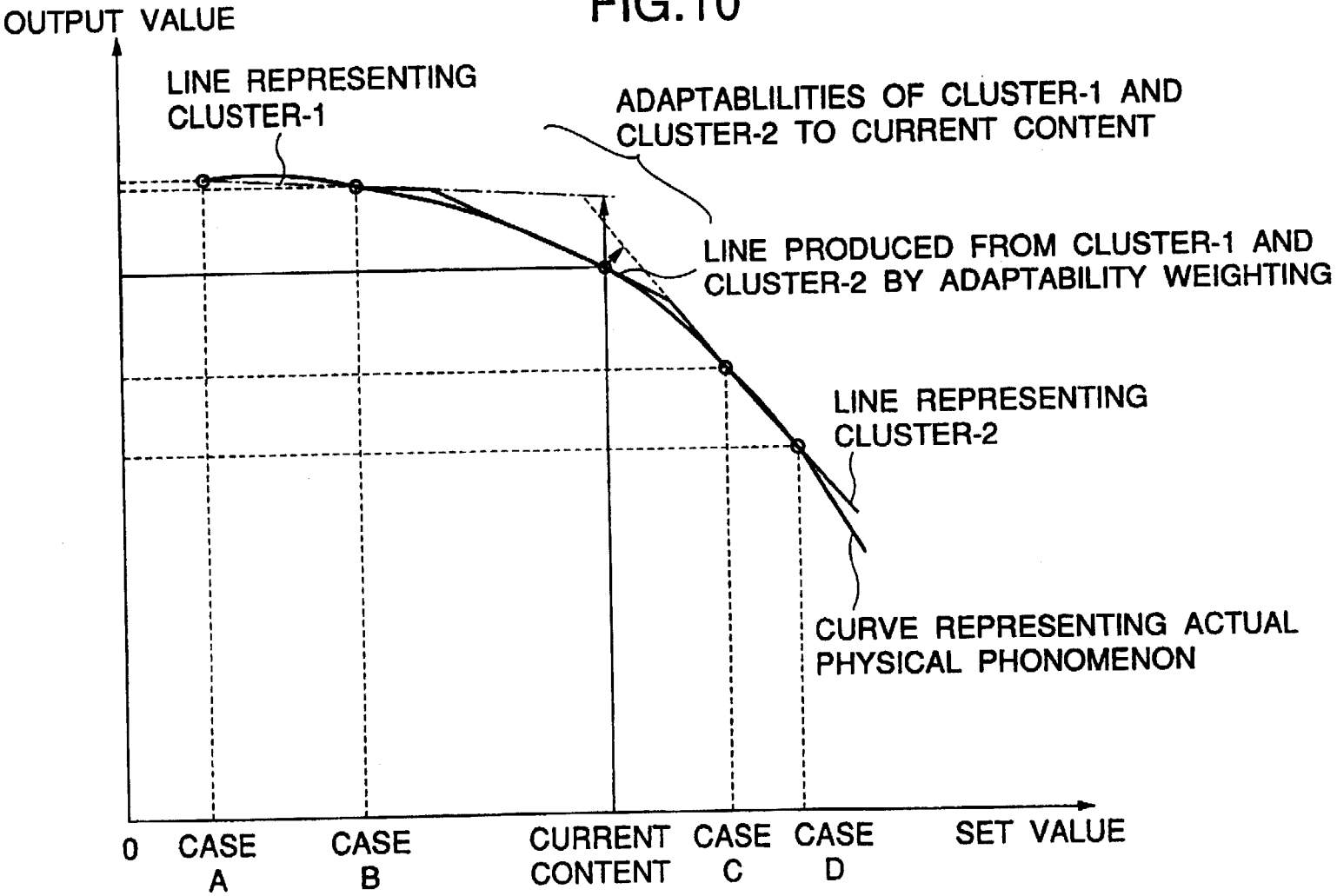
FIG. 10 schematically illustrates that control rule planes of adjacent clusters can be combined to form a new control rule plane by use of adaptabilities to provide as high approximation accuracy as desired.

For ease of understanding, in FIG. 10, a two-dimensional representation, lower by one dimension than in FIG. 9, used (i.e., a straight line instead of a plane, and a curve instead of a curved surface). A control rule and another control rule adjacent to the former are composed depending on the "adaptabilities" of these control rules. Then, at the mid point between the control rules, the adaptabilities of them are each 50%. A plane having an inclination that results from averaging the inclinations of both the adjacent planes is virtually generated. And it is translated so as to be coincident with an actual physical phenomenon. Accordingly, the control is performed in exactly the same state as a smoothly curved surface is present.

Where the approximated curved surface of higher order is used, one control rule covers a broad region, but many control cases must be used for generating one control rule, and hence a response time is correspondingly slow.

Thus, two methods are available for acquiring a control rule. A first method uses simple planes to quickly determine a control rule, and increase and combines the number of planes as occasion demands. A second method uses curved surfaces of higher degree to generate an exact control rule from the outset, and checks the increase in the number of the curved surfaces. One of these control rule acquiring methods is selected in accordance with image forming apparatuses supposed and the control characteristics that the user desires.

(9) The conventional techniques may be used for the formation of the developed image patches and their sensing without any restrictions by the present invention. The developed image patches may be formed every image formation or only before or after a series of jobs, as in the conventional way. Further, those patches may be formed every preset number of prints or at preset time intervals.

As the frequency of repeating the operation of forming and sensing the developed image patches is higher, a reproduction state of the image density will be grasped more accurately, but toner is more consumed. For this reason, it is suggestible to determine this frequency in accordance with the specifications of the image forming apparatuses and the purposes of using the image forming apparatuses.

(10) Status Quantity (10-1) When an error in excess of a tolerable error quantity occurs, it is required to judge as to whether it is caused by a variation of the substantial physical quantities or by an unsatisfactory measurement error of the past control cases thus far stored. If the cause of the error is the substantial physical quantity variation, the control rule per se must be formed anew. If it is merely an unsatisfactory measurement error of the past control cases (large measurement error, for example), not the substantial physical quantity variation, it is more effective in reducing the adverse effect by the error to statistically reduce the individual errors that are contained in the past control cases by using both a new control case and the past control cases. To gain a high precision control rule, it is preferable that as in the setup process of the above-mentioned embodiment, the control case plane is determined by only three cases, and a statistical method, such as the method of least squares, is applied to many control cases for error reduction.

The present invention uses the status quantity as an element of the control case to discriminate the causes of the large error. The control time, which does not need the sensing of physical quantities, is used for the status quantity in the above-mentioned embodiment. A degree of the coincidence of the control times between the control cases is used for checking as to whether or not a status quantity is equal to another status quantity. If the date of a control case is different from that of another control case, it is considered that temperature and humidity for the former is different from those for the latter. The control cases of which the case generation times are close are considered to be formed in like states.

A time distance of the "the case generation times are close" is determined on the basis of the specifications of the image forming apparatus, and the ambient conditions in which the user will operate the image forming apparatus. In an office located in a region where temperature greatly varies, ambient conditions of the image forming apparatus in the morning immediately after the air conditioning starts are greatly different from those in the day time in which the office is fully air conditioned. Thus, the image forming apparatus that utilizes an electrostatic mechanism for image formation experiences a great difference of its ambient conditions.

To cope with this situation, the time distance is flexibly selected. For example, in the forenoon the time distance is one hour or shorter, and in the afternoon it is three hours or shorter. Alternatively, it may be considered that the status quantities before 10:00 am are different from those after the same. Thus, the time distance can be set to be small as desired. When the time distance is too small and the handling of data is troublesome, the following measure may be taken: Data is measured by temperature and humidity sensors, and the measurement data is handled as one of the status quantity of the control case.

(10-2) A relatively simple example of the density control, which is designed to deal with only the daily variation, will be described for ease of understanding. The control cases are classified on the assumption that the control cases of the same date were placed in the same status.

When the result of a density control exceeds a tolerable error quantity, the control unit fetches the control cases, and checks the control times, or the status quantities of the group of the control cases that were used for extracting a control rule used by the density control. To cope with the daily variation, it is necessary to check whether or not the date of the present control case is the same as those of the past control cases. If those control cases have the same dates, the present control case is added to the group of the past control cases, thereby improving the control rule.

If the control cases are formed on different days, the control unit recognizes that the control rule thus far used is invalid, and starts another control rule. The control unit gathers and stores at least "n+1" number of new control cases, and at a time point where the new control cases of "n+1" are gained, it acquires a new control case plane, viz., a new control rule. At a control time point where the new control cases of "n+1" are not reached, such a process may be allowed that the control unit selects the latest control cases from among the past control cases, and uses them for the shortage.

Whether or not the control cases of more than "n+1" are required can uniquely be determined on the basis of the result of a density control that is carried out under the control rule of the new control planes formed by a plural number of control cases of "n+1". That is to say, it can be determined by checking if the result of the density control is within a tolerable error. If it is within the tolerable error, the control rule formed has a satisfactorily high precision control. If it is out of the tolerable error, the control accuracy of the present control rule must be improved by increasing the number of control cases. In this case, the status quantities (the dates) of the control cases subsequent to the (n+1)th control case are compared with those of the control cases preceding to the (n+1)th control case, to thereby check the coincidence between them.

(10-3) It is evident that the improvement of the control rule or the acquisition of a new control rule does not depend on the standard for judging whether the status quantity is in the same state. Various kinds of status quantities can be used for the improvement of the control rule or the acquisition of a new control rule, as long as it can be uniquely determined whether two values of the status quantity are regarded as belonging to the same state. Examples of the status quantity unit for management are a day, one or several hours, a preset variation range of temperature, and a preset number of prints.

(11) In the memory management of the present embodiment, the data is erased by priority of the date of forming the control cases. For the control rule, every time it is used, its adaptability is accumulatively stored, and the resultant adaptabilities may be used for the criterion in erasing the unnecessary control rules. The control rules of low adaptabilities will infrequently be used, and then those are erased at higher priority.

The erasing method based on the accumulative adaptabilities will be described hereinafter. Bear it in mind that the date of forming the control cases is not always the best for the criterion in judging the importance of the control rule. The reason for this is that where the xerography basis image forming apparatus is used, in a region having distinct four seasons, for example, Japan, for the present control rule, for example, in summer, the control rule formed in summer one year ago is sometimes more valid than the control case formed in winter half a year ago.

For this reason, a constant effort to find the most suitable status quantity, which of course includes the rule forming date, to construct a valid control rule, is required. Accordingly, in this instance, every time a control rule is used, its adaptability is stored, and the resultant, accumulated adaptability is used for the criterion in judging the importance of the control rule.

However, the judgement dependent only on the accumulated adaptability will create another problem. The accumulated adaptabilities of the latest control rules are low. On the other hand, the accumulated adaptabilities of the old control rules are high because, although each of them is small (accordingly, its importance is low), those are accumulated many times.

Ambient conditions, such as temperature and humidity, which greatly influences the performances of the image forming apparatus, greatly vary with seasons in some regions, for example, Japan. An accumulative state of the adaptabilities is desirably reckoned with over the period during which seasonal similar ambient conditions under which the control rules were formed continue.

In a specific example, the ambient conditions within past three months are considered to be similar to the ambient conditions at the time (season) of extracting the control rule, and the control rule of the lowest adaptability is selected from those control rules extracted before three months or more and is erased as the control rule of the lowest importance. By so doing, the newest control rule will not be removed. Nevertheless the control rules that are extracted within past three months are infrequently used, and the accumulated adaptabilities thereof are low, those rules will not be removed.

To be more specific, if the control rule is expressed by a linear approximation based on the least squares, the elements of the control rule (cluster) are stored as shown in Table 2.

TABLE 2

| | Time of formation Date/hour/min/sec | Coefficients a a1/a2/a3 | Coefficients b b1/b2/b3 | Cumulative adaptability |
|---|---|---|---|---|
| Control rule 1 | 940401120040 | 12.2/26.7/−4304 | 11.1/24.5/−4082 | 17.62 |
| Control rule 2 | 940402090025 | 5.0/0/−555 | 7.5/−0.8/ | 3.51 −993 |
| ... | ... | ... | ... | ... |

Each control rule in Table 2 consists of the following elements:

a) Coefficients a1 to a3, and b1 to b3 which are contained satisfy the following approximate expressions:

$$\text{Solid density}=a1\times(\text{LP set value})\times a2\times(\text{scoro set value})+a3$$

$$\text{Highlight density}=b1\times(\text{LP set value})\times b2\times(\text{scoro set value})+b3$$

b) Time (second, minute and hour), date, and year when the control rules are extracted, that is, time when the last (latest) control case of the group of the control cases by which the control rule is extracted is formed, and c) Accumulated adaptability Table 2 corresponds to Table 1. The control rule 1 is extracted from the control cases 1 to 3, and the control rule 2, from the cases 4 to 6.

The control rule (cluster) is described in the manner as described above. Accordingly, when the memory capacity that can be used is small, it can be judged whether or not the control rule was formed before three months on the basis of the elements of the date. If it was formed before three months, its accumulated adaptability is compared with the accumulated adaptabilities of other control rules formed before three months, to thereby judge its importance.

When a memory capacity provided ready is small or new control rules are frequently formed, there is the possibility that the memory capacity that can be used runs short before three months. In this case, the oldest data is simply erased with the first priority. Thus, in all cases, the memory area to store the latest data can be secured.

(12) In retrieving the adaptabilities of the control rules and composing them by the control rule retrieval unit, only the adaptabilities larger than a preset value (10% or 20%) may be retrieved and composed, while disregarding the adaptabilities smaller than the preset value. When this process is employed, the density control can be carried out while not being influenced by the control rules having less relation therewith. Accordingly, a high precision control is ensured.

(13) While in the above-mentioned embodiment, the object to be controlled is an image density, it may be line width, sharpness, tone, and like.

As seen from the foregoing description, the invention reduces the number of sensors as small as possible and hence the cost to manufacture. Further, the image forming apparatus can automatically and accurately control an image density to a desired density without previously knowing the adverse affects on the image density by ambient conditions and performance deterioration by aging, to thereby realize a remarkable reduction of the product developing process steps.

Additionally, the invention can always and automatically secure required image density control performance of each of a large number of image forming apparatuses in the market, even if they are used in various ways or part exchange is made when necessary.

According to another aspect, the invention allows an operator to directly specify and set in the control unit a required control accuracy itself and the control unit is adapted to automatically operate to satisfy the required control accuracy, thereby eliminating increases of the manufacturing cost and the number of the product developing process steps which would otherwise be needed to improve the control accuracy.

According to another aspect, the invention enables control while effectively using a limited memory capacity.

What is claimed is:

1. An image forming apparatus comprising:

image quality varying means for varying a quality of an output image in accordance with an operation quantity;

control case storing means for storing a plurality of control cases;

control rule extracting means for extracting from the control case storing means a control rule while referring to a plurality of the control cases that are defined as points in a coordinate system with coordinate axes representing the operation quantity and a control quantity and while computing a new operation quantity;

detecting means for detecting the quality of the output image, and outputting a detection result as the control quantity; and operation quantity computing means for computing a new operation quantity to be supplied to the image quality varying means so that the control quantity becomes a value corresponding to target image quality, by using the control rule extracted by the control rule extracting means.

2. The image forming apparatus according to claim 1, further comprising comparing means for comparing the control quantity with the target image quality, wherein when a comparison result is larger than a tolerable value, a current control case is stored into the control case storing means so as to be used for subsequent control operations.

3. The image forming apparatus according to claim 2, wherein when a residual memory capacity of the control case storing means becomes smaller than a predetermined value as a result of the additional storage of the current control case, an oldest control case is erased from the control case storing means.

4. The image forming apparatus according to claim 1, wherein each of the control cases consists of the operation quantity, the control quantity, and a status quantity that indicates a status of the image forming apparatus.

5. The image forming apparatus according to claim 1, wherein the output image quality is an image density.

6. An image forming apparatus comprising:

image quality varying means for varying a quality of an output image in accordance with an operation quantity;

cluster storing means for storing, as a cluster, a collection of control cases having a similar status quantity;

cluster-discriminated control rule extracting means for extracting control rules while referring to a plurality of the control cases that are defined as points in a coordinate system with coordinate axes representing the operation quantity and a control quantity for the respective clusters stored in the cluster storing means and while computing a new operation quantity;

detecting means for detecting the quality of the output image, and outputting a detection result as the control quantity; and control quantity computing means for computing a new operation quantity to be supplied to the image quality varying means so that the control quantity becomes a value corresponding to target image quality, by using the control rules extracted by the cluster-discriminated control rule extracting means.

7. An image forming apparatus comprising:

image quality varying means for varying quality of an output image in accordance with an operation quantity;

cluster storing means for storing, as a cluster, a collection of control cases having a similar status quantity;

cluster-discriminated control rule extracting means for extracting control rules for the respective clusters stored in the cluster storing means;

detecting means for detecting the quality of the output image, and outputting a detection result as a control quantity; and operation quantity computing means for computing a new operation quantity to be supplied to the image quality varying means so that the control quantity becomes a value corresponding to target image quality, by using the control rules extracted by the cluster-discriminated control rule extracting means;

wherein the operation quantity computing means determines adaptabilities of the respective control rules extracted by the cluster-discriminated control rule extracting means to a current control case, weights the control rules in accordance with the respective adaptabilities, calculates an average of the weighted control rules, and determines the new operation quantity by using the average control rule.

8. The image forming apparatus according to claim 7, wherein the operation quantity computing means determines the adaptabilities by normalizing reciprocals of distances between a coordinate point of the current control case and n-dimensional planes representing the respective control rules in a coordinate space for describing the control rules.

9. The image forming apparatus according to claim 7, wherein the operation quantity computing means computes the new operation quantity by using part of the control rules excluding control rules having the adaptabilities smaller than a predetermined value.

10. The image forming apparatus according to claim 7, further comprising comparing means for comparing the control quantity with the target image quality, wherein when a comparison result is larger than a tolerable value, a current control case is added to a corresponding one of the clusters stored in the cluster storing means so as to be used for subsequent control operations.

11. The image forming apparatus according to claim 10, wherein when a residual memory capacity of the cluster storing means becomes smaller than a predetermined value as a result of the addition of the current control case, an oldest control case is erased from the cluster storing means.

12. The image forming apparatus according to claim 7, further comprising control rule storing means for storing the control rules together with time data indicating time points of formation of the respective control rules, and for updating and storing accumulative values of the adaptabilities of the respective control rules, wherein when a residual memory capacity of the control rule storing means becomes smaller than a predetermined value, a control rule formed before a predetermined time point and having a smallest accumulative adaptability is erased from the control rule storing means.

13. The image forming apparatus according to claim 7, further comprising control case storing means for storing control cases, wherein the cluster storing means stores, as the cluster, a collection of control cases that are stored in the control case storing means and are similar in the status quantity, and wherein, when one cluster is completed, control cases constituting the one cluster are erased from the control case storing means.

14. The image forming apparatus according to claim 7, wherein each of the control cases consists of the operation quantity, the control quantity, and a status quantity that indicates a status of the image forming apparatus.

15. The image forming apparatus according to claim 7, wherein the output image quality is an image density.

16. An image forming apparatus comprising:

image quality varying means for varying quality of an output image in accordance with an operation quantity;

control case storing means for storing a plurality of control cases;

control rule extracting means for extracting a control rule from the control cases stored in the control case storing means;

detecting means for detecting the quality of the output image, and outputting a detection result as a control quantity; and operation quantity computing means for computing a new operation quantity to be supplied to the image quality varying means so that the control quantity becomes a value corresponding to target image quality, by using the control rule extracted by the control rule extracting means;

wherein the control rule is extracted as an n-dimensional, least-square-error plane of a plurality of coordinate points indicating the control cases in an (n+1)-dimensional space that is constituted of n axes representing n operation quantities and an axis representing the control quantity.

17. An image forming apparatus which attains target image quality by determining an operation quantity that influences image quality of the image forming apparatus, comprising:

means for specifying a control target value of the image quality;

image quality varying means for varying the image quality in accordance with the operation quantity;

means for detecting, as a current control object quantity, current image quality corresponding to a current operation quantity;

a control rule memory for storing a plurality of plane control rules each including a plurality of control cases that are defined as points in a coordinate system constituted of coordinate axes representing the operation quantity and a control object quantity;

means for calculating adaptabilities of all the plane control rules stored in the control rule memory to the current control object quantity;

means for generating a new plane control rule including a control case that indicates the current control object quantity based on all the plane control rules in accordance with the calculated adaptabilities; and means for determining a new operation quantity for the specified control target value to be supplied to the image quality varying means, by using the new plane control rule.

18. The image forming apparatus according to claim 17, wherein the control rule memory stores parameters of each of a plurality of equations representing the respective plane control rules in the coordinate system, and wherein the new plane control rule generating means comprises:

means for generating the equations by using the parameters read from the control rule memory;

image quality calculating means for calculating image quality values corresponding to the current operation quantity under the respective plane control rules by substituting the current operation quantity into the respective equations;

difference calculating means for calculating, along the coordinate axis of the control object quantity, differences between the current control object quantity and the image quality values corresponding to the current operation quantity;

means for determining the adaptabilities under a rule that the adaptability of a plane control rule having a smaller difference is larger; and means for generating the new plane control rule having such values that a ratio among differences between the current control subject quantity and the respective plane control rules corresponding to the current operation quantity as measured along the axis of the control subject quantity is equal to a ratio among differences between an arbitrary control object quantity and the respective plane control rules corresponding to the arbitrary control object quantity as measured along the coordinate axis of the control object quantity.

19. An image forming apparatus comprising:

image quality varying means for varying quality of an output image in accordance with an operation quantity;

cluster storing means for storing, as a cluster, a collection of control cases having a similar status quantity;

cluster-discriminated control rule extracting means for extracting control rules for the respective clusters stored in the cluster storing means;

detecting means for detecting the quality of the output image, and outputting a detection result as a control quantity; and operation quantity computing means for computing a new operation quantity to be supplied to the image quality varying means so that the control quantity becomes a value corresponding to target image quality, by using the control rules extracted by the cluster-discriminated control rule extracting means, wherein the control rule is extracted as an n-dimensional, least-square-error plane of a plurality of coordinate points indicating the control cases in an (n+1)-dimensional space that is constituted of n axes representing n operation quantities and an axis representing the control quantity.

* * * * *